US009939205B2

(12) United States Patent
Sun et al.

(10) Patent No.: US 9,939,205 B2
(45) Date of Patent: Apr. 10, 2018

(54) HEAT DISSIPATER HAVING CAPILLARY COMPONENT

(71) Applicant: COOLER MASTER CO., LTD., New Taipei (TW)

(72) Inventors: Chien-Hung Sun, New Taipei (TW); Lei-Lei Liu, New Taipei (TW); Xiao-Min Zhang, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 265 days.

(21) Appl. No.: 14/676,817

(22) Filed: Apr. 2, 2015

(65) Prior Publication Data

US 2016/0003555 A1 Jan. 7, 2016

(30) Foreign Application Priority Data

Jul. 4, 2014 (CN) ..... 2014 2 0368548 U

(51) Int. Cl.
*F28D 15/04* (2006.01)
*F28D 15/02* (2006.01)

(52) U.S. Cl.
CPC ..... *F28D 15/046* (2013.01); *F28D 15/0266* (2013.01)

(58) Field of Classification Search
CPC ..... F28D 15/0283
USPC ..... 165/80.4
See application file for complete search history.

(56) References Cited

U.S. PATENT DOCUMENTS 4,675,783 A * 6/1987 Murase ..... F28D 15/0275 165/104.14
6,237,223 B1 * 5/2001 McCullough ..... B23P 15/26 257/E23.089
7,357,174 B2 * 4/2008 Hsu ..... H01L 23/3672 165/104.21
2004/0105235 A1 * 6/2004 Lai ..... F28D 15/0266 361/700
2005/0173098 A1 * 8/2005 Connors ..... F28D 15/02 165/104.33
2005/0199376 A1 * 9/2005 Lee ..... F28D 15/0233 165/104.26
2005/0236143 A1 * 10/2005 Garner ..... F28D 15/0233 165/104.26
2005/0247434 A1 * 11/2005 Sheng ..... F28D 15/0275 165/104.21

(Continued)

*Primary Examiner* — Grant Moubry
*Assistant Examiner* — Paul Schwarzenberg
(74) *Attorney, Agent, or Firm* — Maschoff Brennan

(57) ABSTRACT

A heat dissipater having capillary component includes: a heat spreader including a shell member having at least one through hole and a first capillary structure disposed in the shell member; a heat pipe, received in the through hole and including a pipe member and a second capillary structure disposed in the pipe member. The pipe member includes an opening formed in the shell member; and a capillary component, accommodated in the shell member and including a block member extended with a protruding part and arranged adjacent to the first capillary structure. The protruding part is received in the opening and arranged adjacent to the second capillary structure. Accordingly, the heat pipe and the heat spreader can be combined for operation, and an internal working fluid can flow between the heat pipe and the heat spreader.

6 Claims, 8 Drawing Sheets

(56) References Cited

U.S. PATENT DOCUMENTS

| | | | | |
|---|---|---|---|---|
| 2006/0060330 | A1* | 3/2006 | Siu | F28D 15/0233 165/104.26 |
| 2007/0272399 | A1* | 11/2007 | Nitta | F28D 15/0233 165/185 |
| 2008/0308257 | A1* | 12/2008 | Peng | F28D 15/0266 165/104.19 |
| 2010/0263834 | A1* | 10/2010 | Hwang | H01L 23/3672 165/104.26 |
| 2014/0293541 | A1* | 10/2014 | Opila | F28D 15/02 361/697 |

* cited by examiner

HEAT DISSIPATER HAVING CAPILLARY COMPONENT

BACKGROUND OF THE INVENTION

Field of the Invention

The present invention relates to a heat dissipater used in a circuit board or an electronic device, especially to a heat dissipater having capillary component.

Description of Related Art

With the technology being well developed, a modern electronic device has a trend of being thinner and smaller, so electric components inside the electronic device are also required to be smaller. However, under the situation of the dimension of the electric component being smaller and the performance thereof being higher, massive amount of heat will be generated when the electric component is operated, if the heat is unable to be dissipated and accumulated in the electric component, the temperature of the electric component would be continuously raised and the electric component may be damaged due to the heat.

A conventional means for dissipating the heat generated by an electric component is to allow a heat dissipater to be connected to the electric component for dissipating the heat to the exterior. The heat dissipater includes a heat conductive block and a heat pipe installed in the heat conductive block, and the heat conductive block is arranged adjacent to the electric component and the heat pipe is served to transfer heat to the exterior; or, the heat dissipater can also include a heat spreader which is directly installed on the electric component.

However, the modern electric component often requires more than one heat pipe or the heat spreader, but the heat pipe has a shortage of having high diffusion thermal resistance and the heat spreader has a shortage of having narrow heat transferring direction. As such, how to combine the heat pipe and the heat spreader for enabling an internal working fluid to flow between the heat pipe and the heat spreader shall be a serious issue for improving the performance of a heat spreader.

Accordingly, the applicant of the present invention has devoted himself for improving the mentioned disadvantages.

SUMMARY OF THE INVENTION

The present invention is to provide a heat dissipater having capillary component, in which at least one heat pipe and a heat spreader are combined for operation, so an internal working fluid is able to flow between the heat pipe and the heat spreader, thereby allowing the heat dissipater to be provided with an excellent heat dissipating efficiency.

Accordingly, the present invention provides a heat dissipater having capillary component, which includes:

a heat spreader, including a shell member and a first capillary structure disposed in the shell member, wherein the shell member includes at least one through hole;

at least one heat pipe, received in the through hole and including a pipe member and a second capillary structure disposed in the pipe member, wherein the pipe member includes an opening formed in the shell member; and at least one capillary component, accommodated in the shell member and including a block member, wherein the block member is extended with a protruding part, the block member is arranged adjacent to the first capillary structure, and the protruding part is received in the opening and arranged adjacent to the second capillary structure.

Wherein, the block member is formed with a hollow zone, and the hollow zone is connected with the shell member and the pipe member.

Wherein, the hollow zone includes a penetrated hole formed in the block member, the protruding part includes a convex piece extended from the block member, the convex piece is arranged at one side defined at the outer periphery of the penetrated hole, and the convex piece is received in the opening and arranged adjacent to the second capillary structure.

Wherein, the hollow zone includes a penetrated hole formed in the block member, the protruding part includes an annular piece extended from the block member, the annular piece is arranged at the outer periphery of the penetrated hole, and the annular piece is received in the opening and arranged adjacent to the second capillary structure.

Wherein, the hollow zone includes a groove formed at one side of the block member, the protruding part includes a convex piece extended from the block member, the convex piece is arranged at the outer periphery of the groove, and the convex piece is received in the opening and arranged adjacent to the second capillary structure.

Wherein, the first capillary structure and the second capillary structure are respectively composed of a sintered member, a metal net member, one or a plurality of grooves or a combination thereof.

Wherein, the capillary component is composed of a sintered member, a metal net member, one or a plurality of grooves or a combination thereof.

Wherein, the heat pipe is formed with a condense segment, and the condense segment is arranged to be in parallel with the heat spreader.

Wherein, the heat pipe is formed with a condense segment, and the condense segment is arranged to be perpendicular to the heat spreader.

Wherein, the shell member includes a base and a cover plate covered on the base, the base is formed with a bottom wall and an annular wall annularly arranged on the bottom wall, the bottom wall is formed with a plurality of support pieces extended towards the cover plate, the through hole is formed on the annular wall, and the first capillary structure is disposed on the bottom wall.

Accordingly, the present invention provides a heat dissipater having capillary component, which includes:

a heat spreader, including a shell member and a first capillary structure disposed in the shell member, wherein the shell member includes a plurality of through holes;

a plurality of heat pipes, respectively received in each of the through holes and respectively including a pipe member and a second capillary structure disposed in the pipe member, wherein each of the pipe members includes an opening formed in the shell member; and a capillary component, accommodated in the shell member and including a block member, wherein the block member is extended with a plurality of protruding parts, the block member is arranged adjacent to the first capillary structure, and each of the protruding parts is received in each of the openings and arranged adjacent to each of the second capillary structures.

Wherein, the block member is formed with a plurality of hollow zones, and each of the hollow zones is connected with the shell member and each of the pipe members.

Wherein, each of the hollow zones includes a penetrated hole formed in the block member, each of the protruding parts includes a convex piece extended from the block member, each of the convex pieces is arranged at one side defined at the outer periphery of each of the penetrated holes, and each of the convex pieces is received in each of the openings and arranged adjacent to each of the second capillary structures.

Wherein, each of the hollow zones includes a penetrated hole formed in the block member, each of the protruding parts includes an annular piece extended from the block member, each of the annular pieces is arranged at the outer periphery of each of the penetrated holes, and each of the annular pieces is received in each of the openings and arranged adjacent to each of the second capillary structures.

Wherein, each of the hollow zones includes a groove formed at one side of the block member, each of the protruding parts includes a convex piece extended from the block member, each of the convex pieces is arranged at the outer periphery of each of the grooves, and each of the convex pieces is received in each of the openings and arranged adjacent to each of the second capillary structures.

Wherein, the first capillary structure and the second capillary structures are respectively composed of a sintered member, a metal net member, one or a plurality of grooves or a combination thereof.

Wherein, the capillary component is composed of a sintered member, a metal net member, one or a plurality of grooves or a combination thereof.

Wherein, each of the heat pipes is formed with a condense segment, and the condense segments are arranged to be in parallel with the heat spreader.

Wherein, each of the heat pipes is formed with a condense segment, and the condense segments are arranged to be perpendicular to the heat spreader.

Wherein, the shell member includes a base and a cover plate covered on the base, the base is formed with a bottom wall and an annular wall annularly arranged on the bottom wall, the bottom wall is formed with a plurality of support pieces extended towards the cover plate, the plural through holes are formed on the annular wall, and the first capillary structure is disposed on the bottom wall.

Advantages achieved by the present invention are as follows:

First, the capillary component is adjacently connected between the first capillary structure and the second capillary structure, so a working fluid is able to flow from the heat pipe to the heat spreader through the capillary component, thereby allowing the present invention to be provided with advantages of having the low diffusion thermal resistance of the heat spreader and the wide heat transferring direction of the heat pipe.

Second, the block member includes the protruding part and the hollow zone, so the capillary component can be easily installed on the heat pipe, and the hollow zone is able to assist the gas-phase working fluid to more smoothly flow from the heat spreader to the heat pipe.

DETAILED DESCRIPTION OF THE INVENTION

Figure 1:
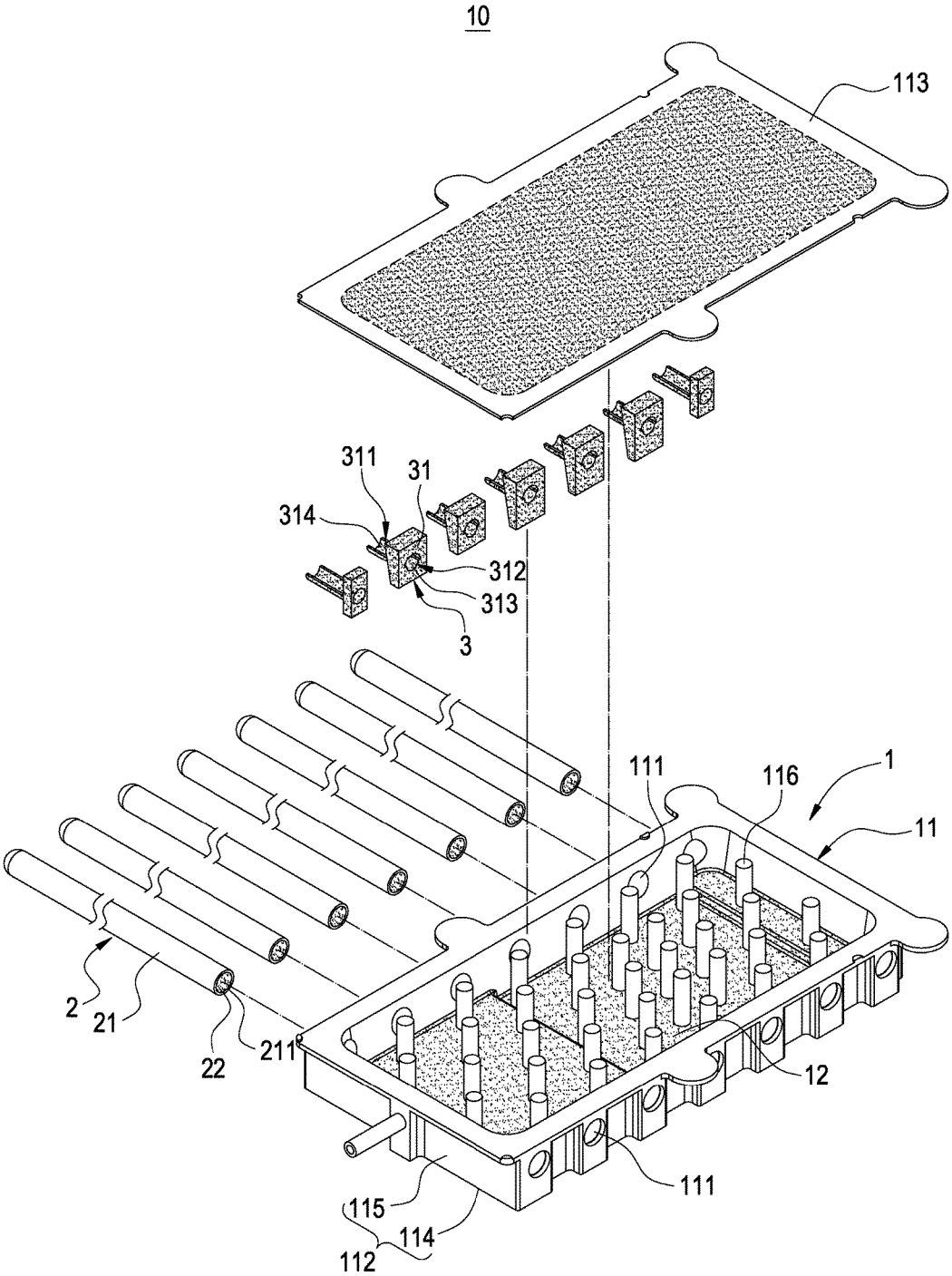
FIG. 1 is a perspective exploded view showing the heat dissipater according to the present invention.

Preferred embodiments of the present invention will be described with reference to the drawings.

Please refer to FIG. 1 to FIG. 5, the present invention provides a heat dissipater having capillary component. The heat dissipater (10) mainly includes a heat spreader (1), one or a plurality of heat pipes (2) and one or a plurality of capillary components (3).

The heat spreader (1) includes a shell member (11) and a first capillary structure (12) disposed in the shell member (11). The shell member (11) includes one or a plurality of through holes (111). Wherein, the first capillary structure (12) is composed of a sintered member, a metal net member, one or a plurality of grooves or a combination thereof.

Details are provided as follow. The shell member (11) includes a base (112) and a cover plate (113) covered on the base (112). The base (112) is formed with a bottom wall (114) and an annular wall (115) annularly arranged on the bottom wall (114). The bottom wall (114) is formed with a plurality of support pieces (116) extended towards the cover plate (113). The first capillary structure (12) is disposed on the bottom wall (114). Wherein, according to this embodiment, the quantity of the through hole (111) is preferably to be plural, what shall be addressed is that the scope of the present invention is not limited by the quantity of the through hole (111), and the plural through holes (111) are formed on the annular wall (115).

According to this embodiment, the quantity of the heat pipe (2) is preferably to be plural, and what shall be addressed is that the scope of the present invention is not limited by the quantity of the heat pipe (2). Each of the heat pipes (2) respectively includes a pipe member (21) and a second capillary structure (22) disposed in the pipe member (21). Each of the pipe members (21) includes an opening (211) formed in the shell member (11). Each of the heat pipes (2) is formed with a condense segment (23). Each of the condense segments (23) is connected to a plurality of heat dissipation fins and arranged to be in parallel with the heat spreader (1). Wherein, each of the second capillary structures (22) is composed of a sintered member, a metal net member, one or a plurality of grooves or a combination thereof.

According to this embodiment, the quantity of the capillary component (3) is preferably to be plural, and what shall be addressed is that the scope of the present invention is not limited by the quantity of the capillary component (3). Each of the capillary components (3) is accommodated in the shell member (11). Each of the capillary components (3) is formed with a block member (31). Each of the block members (31) is extended with a protruding part (311). Each of the block members (31) is arranged adjacent to the first capillary structure (12). Each of the protruding parts (311) is received in the corresponding opening (211). Wherein, each of the capillary components (3) is composed of a sintered member, a metal net member, one or a plurality of grooves or a combination thereof.

Details are provided as follows. Each of the block members (31) is formed with a hollow zone (312). Each of the hollow zones (312) is respectively connected with the interior of the shell member (11) and the interior of each of the pipe members (21).

In addition, each of the hollow zones (312) includes a penetrated hole (313) formed in the block member (31). Each of the protruding parts (311) includes a convex piece (314) extended from the block member (31). Each of the convex pieces (314) is arranged at one side defined at the outer periphery of the penetrated hole (313). Each of the convex pieces (314) is received in the corresponding opening (211) and arranged adjacent to the corresponding second capillary structure (22).

Moreover, according to the present invention, the appearance of the convex piece (314) can be formed as a U-like member, what shall be addressed is that the scope of the present invention is not limited by the appearance of the convex piece (314), and the appearance of the convex piece (314) can also be formed as other geometrical members such as an I-like member, a V-like member or a rectangular member having one opened side.

Furthermore, each of the block members (31) is arranged adjacent to the first capillary structure (12), and each of the protruding parts (311) is arranged adjacent to the corresponding second capillary structure (22), so when the heat spreader (1), the heat pipes (2) and the capillary components (3) are processed with a heat treatment, each of the block members (31) is allowed to be more adjacent to the first capillary structure (12) and each of the protruding parts (311) is allowed to be more adjacent to the corresponding second capillary structure (22).

Figure 4:
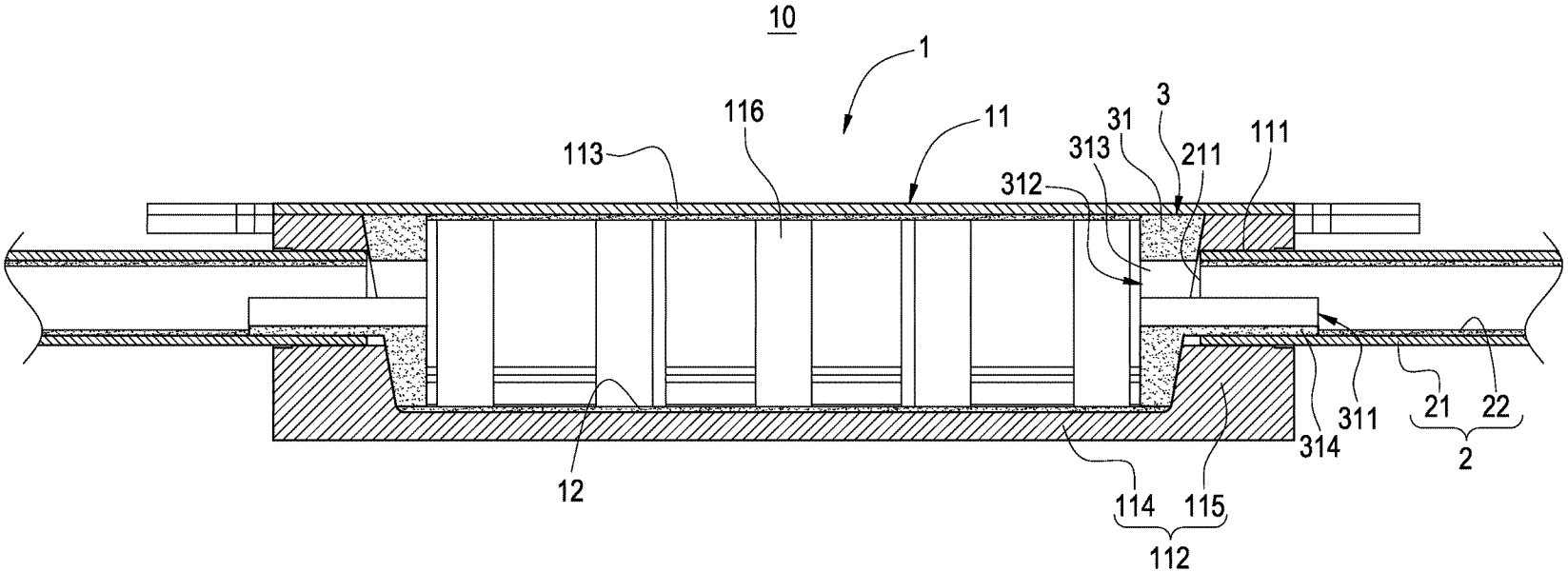
FIG. 4 is a schematic view showing the operating status of the heat dissipater according to the present invention.
Figure 5:
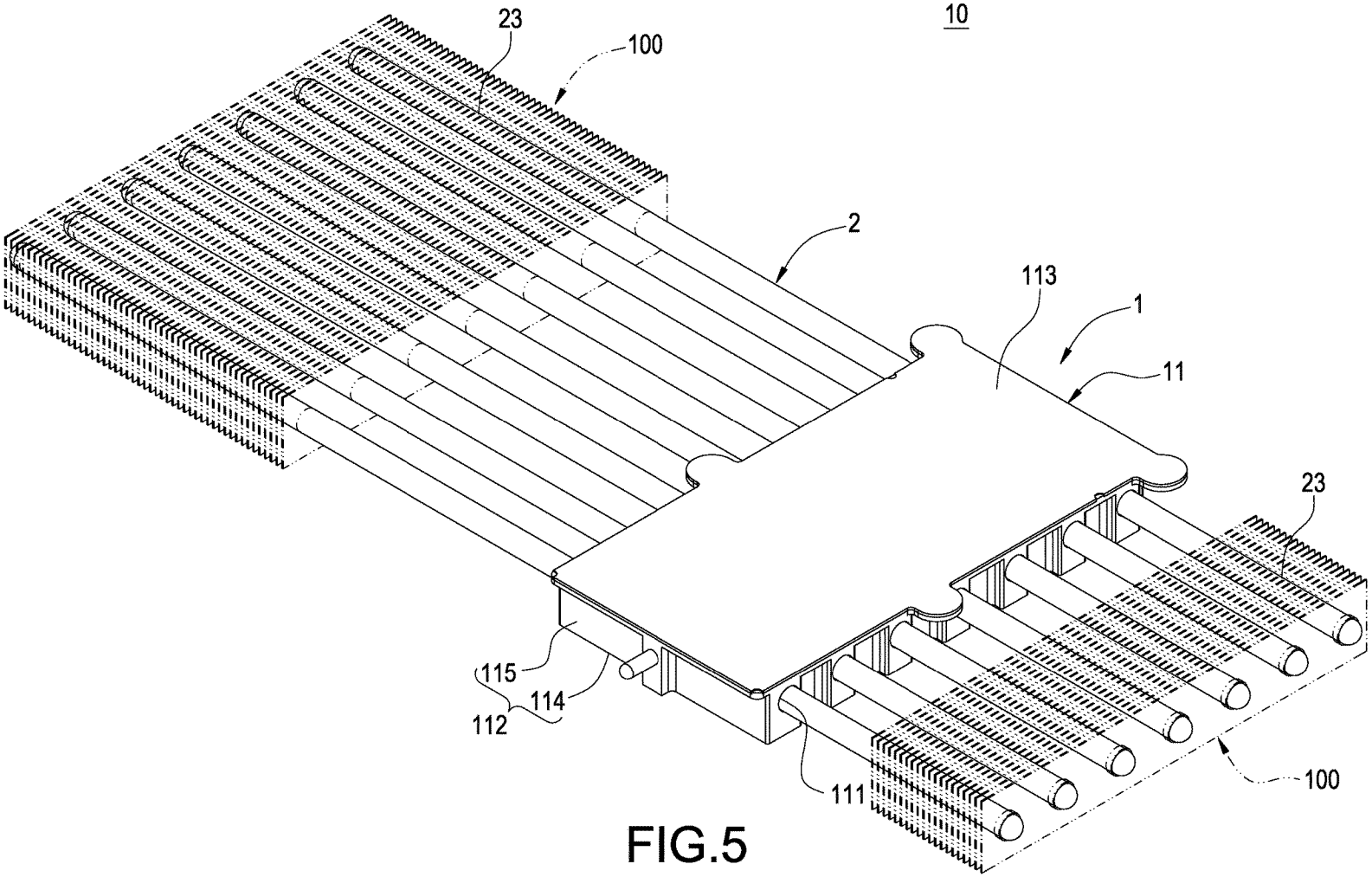
FIG. 5 is a schematic view showing the condense segment being arranged to be parallel with the heat spreader according to the present invention.

As shown in FIG. 4 and FIG. 5, the assembly of the heat dissipater (10) provided by the present invention is that: the heat spreader (1) includes the shell member (11) and the first capillary structure (12) disposed in the shell member (11), and the shell member (11) includes the through holes (111); the heat pipes (2) are received in the through holes (111), each of the heat pipes (2) includes the pipe member (21) and the second capillary structure (22) disposed in the pipe member (21), and the pipe member (21) includes the opening (211) formed in the shell member (11); the capillary structures (3) are accommodated in the shell member (11), each of the capillary components (3) includes the block member (31), the block member (31) is extended with the protruding part (311), the block member (31) is arranged adjacent to the first capillary structure (12), the protruding part (311) is received in the opening (211) and arranged adjacent to the second capillary structure (22). Accordingly, the heat pipes (2) and the heat spreader (1) are able to be combined for operation, and an internal working fluid is able to flow between the heat pipes (2) and the heat spreader (1), thereby allowing the heat dissipater (10) to be provided with an excellent heat dissipating efficiency.

Figure 6:
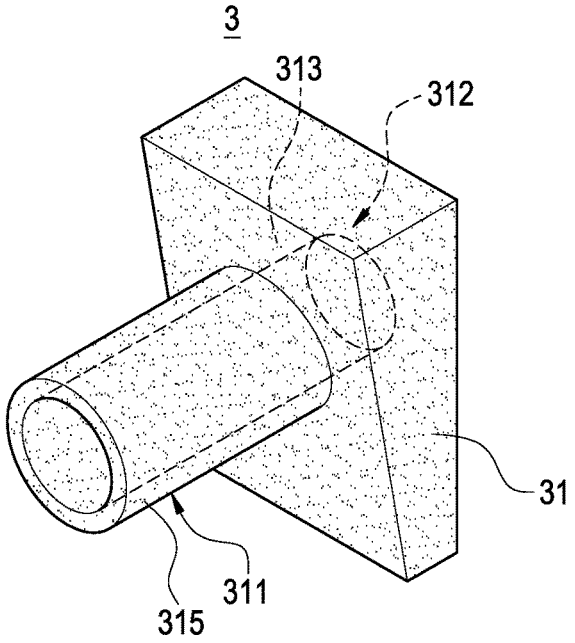
FIG. 6 is a perspective view showing the capillary structure according to a second embodiment of the present invention.

As shown in FIG. 4 and FIG. 6, the operating status of the heat dissipater (10) provided by the present invention is that: through the block member (31) being arranged adjacent to the first capillary structure (12) and each of the protruding parts (311) being arranged adjacent to the corresponding second capillary structure (22), the capillary components (3) are able to be adjacently connected between the first capillary structure (12) and the second capillary structures (22), so the working fluid is able to flow from the second capillary structures (22) back to the first capillary structure (12) through the capillary components (3), thereby enabling the heat spreader (1) and the heat pipes (2) to form a heat dissipating loop.

When the working fluid flows to the first capillary structure (12), because the heat area of the heat spreader (1) is relatively larger, the working fluid is enabled to rapidly generate a phase changing from liquid phase to gas phase, and the gas-phase working fluid is guided by the heat pipes (2) for being away from the heat spreader (1) and towards the condense segments (23) so as to generate a condensing phenomenon, then the liquid-phase working fluid is able to sequentially flow from the second capillary structures (22) and the capillary components (3) then back to the first capillary structure (12). As such, the heat dissipater (10) provided by the present invention is provided with advantages of having the low diffusion thermal resistance of the heat spreader (1) and the wide heat transferring direction of the heat pipe (2).

In addition, the block member (31) is formed with the hollow zone (312). The hollow zone (312) includes the penetrated hole (313) formed in the block member (31). The protruding part (311) includes the convex piece (314) extended from the block member (31). The convex piece (314) is arranged at one side defined at the outer periphery of the penetrated hole (313). The convex piece (314) is received in the opening (211) and arranged adjacent to the second capillary structure (22). The penetrated hole (313) and the interior of the shell member (11) are connected with the interior of each of the pipe members (21). As such, the capillary component (3) is provided with advantages of being easily to be received in the pipe member (21) and easily to be arranged adjacent to the second capillary structure (22), and the penetrated hole (313) is able to assist the gas-phase working fluid to more smoothly flow from the shell member (11) to the pipe member (21).

Please refer to FIG. 6, which discloses a second embodiment of the capillary component (3) provided by the present invention, the second embodiment is substantially the same as the first embodiment, and the difference between the second embodiment and the first embodiment is the structure of the protruding part (311), wherein the protruding part (311) disclosed in the second embodiment includes an annular piece (315) extended from the block member (31).

According to this embodiment, the hollow zone (312) includes the penetrated hole (313) formed in the block member (31). The protruding part (311) includes the annular piece (315) extended from the block member (31). The annular piece (315) is arranged at the outer periphery of the penetrated hole (313), so the interior of the annular piece (315) is able to be connected with the penetrated hole (313).

Wherein, according to this embodiment, the appearance of the annular piece (315) is formed as a circular piece, what shall be addressed is that the appearance of the annular piece (315) is not limited to the above-mentioned arrangement, and the appearance of the annular piece (315) can also be formed as other geometrical pieces such as a triangular piece, a rectangular piece or a pentagonal piece according to actual needs.

Figure 2:
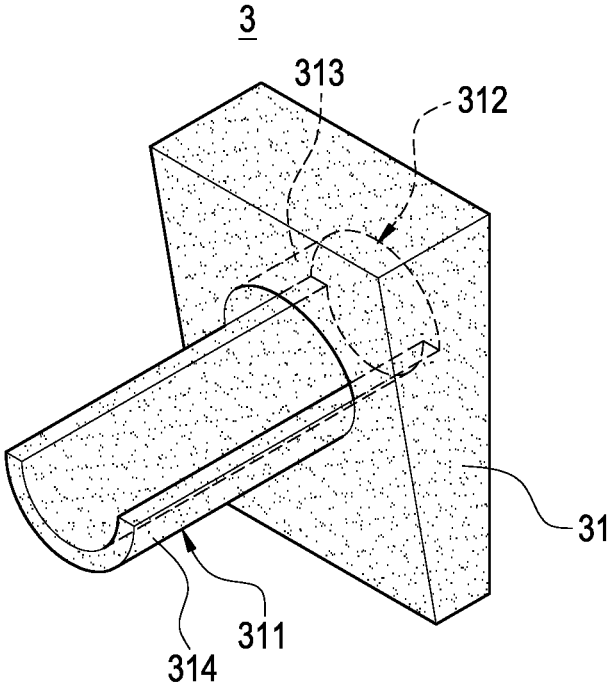
FIG. 2 is a perspective view showing the capillary structure according to a first embodiment of the present invention.
Figure 3:
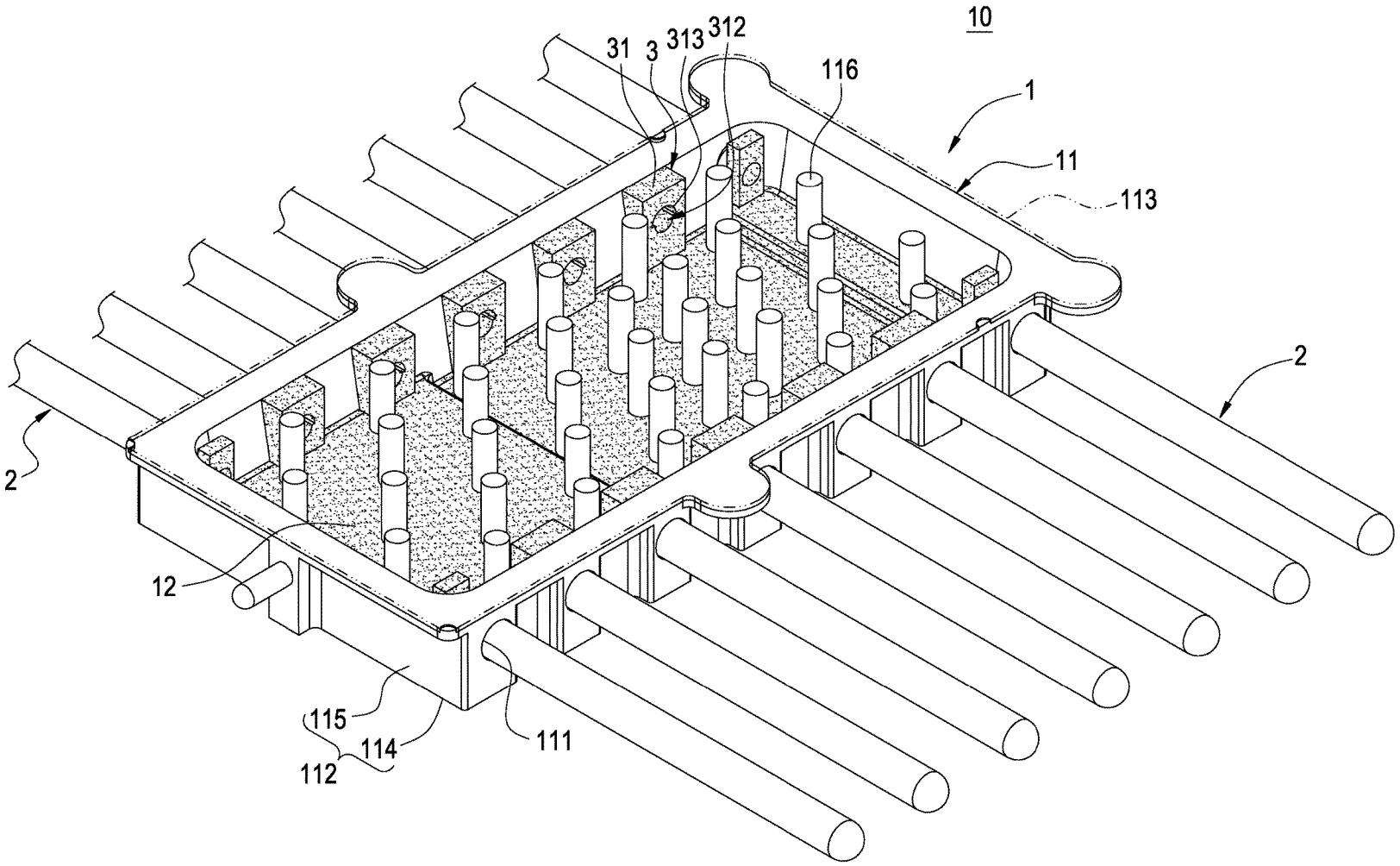
FIG. 3 is a perspective view showing the assembly of the heat dissipater according to the present invention.

Moreover, as shown in FIG. 3 and FIG. 4, the capillary component (3) disclosed in the second embodiment is exchanged with the capillary component (3) disclosed in the first embodiment, so each of the annular pieces (315) is received in the opening (211) and arranged adjacent to the each of the second capillary structures (22), and the interior of the annular piece (315), the penetrated hole (313) and the interior of the shell member (11) are connected with the interior of each of the pipe members (21). As such, the same functions and effects disclosed from FIG. 1 to FIG. 5 can be achieved.

Figure 7:
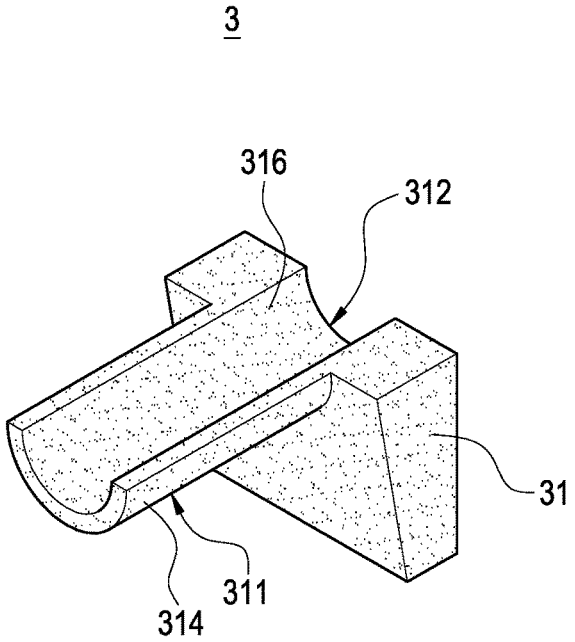
FIG. 7 is a perspective view showing the capillary structure according to a third embodiment of the present invention.

Please refer to FIG. 7, which discloses a third embodiment of the capillary component (3) provided by the present invention, the third embodiment is substantially the same as the first embodiment, and the difference between the third embodiment and the first embodiment is the structure of the hollow zone (312), wherein the hollow zone (312) disclosed in the third embodiment includes a groove (316) formed at one side of the block member (31).

According to this embodiment, the hollow zone (312) includes the groove (316) formed at one side of the block member (31). The protruding part (311) includes the convex piece (314) extended from the block member (31). The convex piece (314) is arranged at the outer periphery of the groove (316).

In addition, as shown in FIG. 3 and FIG. 4, the capillary component (3) disclosed in the third embodiment is exchanged with the capillary component (3) disclosed in the first embodiment, so each of the convex pieces (314) is received in the corresponding opening (211) and arranged adjacent to the corresponding second capillary structure (22); and the groove (316) and the interior of the shell member (11) are connected with the interior of each of the pipe members (21). As such, the same functions and effects disclosed from FIG. 1 to FIG. 5 can be achieved.

Figure 8:
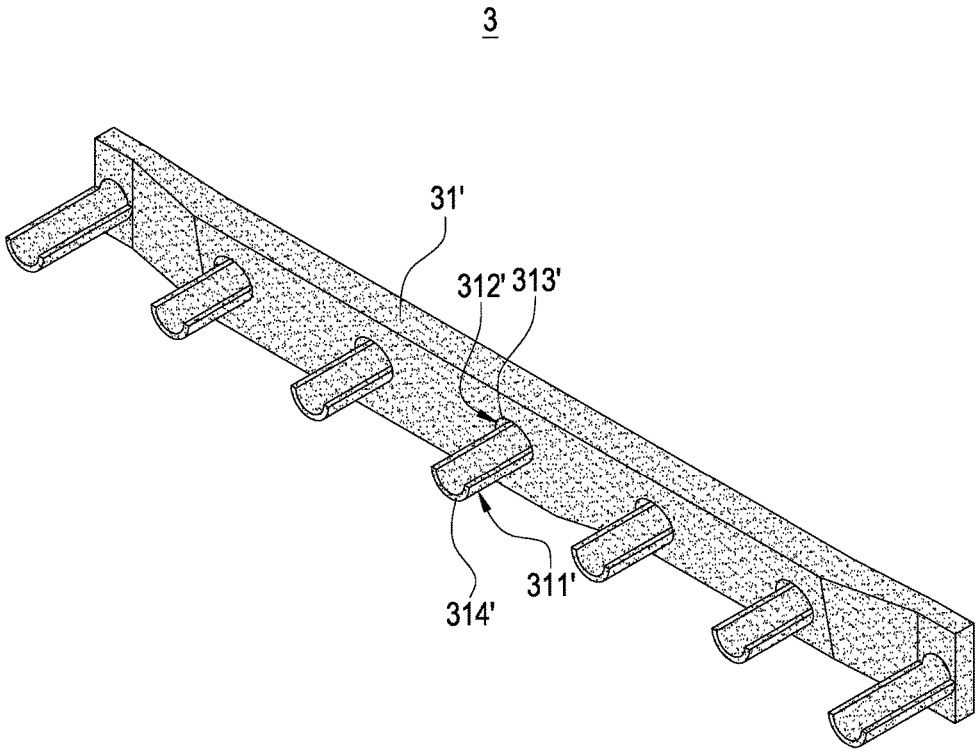
FIG. 8 is a perspective view showing the capillary structure according to a fourth embodiment of the present invention.

Please refer to FIG. 8, which discloses a fourth embodiment of the capillary component (3) provided by the present invention, the fourth embodiment is substantially the same as the first embodiment, and the difference between the fourth embodiment and the first embodiment is that the quantity of protruding part (311') and the quantity of hollow zone (312') of a block member (31') are both plural.

Details are provided as follows. The block member (31') is extended with a plurality of protruding parts (311') and a plurality of hollow zones (312'). Moreover, as shown in FIG. 3 and FIG. 4, the capillary component (3) disclosed in the fourth embodiment is exchanged with the capillary component (3) disclosed in the first embodiment, so the block member (31') is arranged adjacent to the first capillary structure (12), each of the protruding parts (311') is received in each of the openings (211) and arranged adjacent to each of the second capillary structures (22), so single capillary component (3) can be corresponding to a plurality of the heat pipes (2) for operation. As such, the same functions and effects disclosed from FIG. 1 to FIG. 5 can be achieved.

In addition, according to this embodiment, the structure of the protruding part (311) and the structure of the hollow zone (312) disclosed in FIG. 2 can be served as an example for the structure of the protruding part (311') and the structure of the hollow zone (312'). In other words, each of the hollow zones (312') includes a penetrated hole (313') formed in the block member (31'). Each of the protruding parts (311') includes a convex piece (314') extended from the block member (31'). Each of the convex pieces (314') is arranged at one side defined at the outer periphery of each of the protruding parts (313'). As shown in FIG. 3 and FIG. 4, each of the convex pieces (314') is received in each of the openings (211) and arranged adjacent to each of the second capillary structures (22).

Thus, according to this embodiment, the structure of the protruding part (311') and the structure of the hollow zone (312') are not limited by the structure of the protruding part (311) and the structure of the hollow zone (312) disclosed in FIG. 2, and the structure of the protruding part (311) and the structure of the hollow zone (312) disclosed in FIG. 6 and FIG. 7 can also be served as an example for the structure of the protruding part (311') and the structure of the hollow zone (312').

Figure 9:
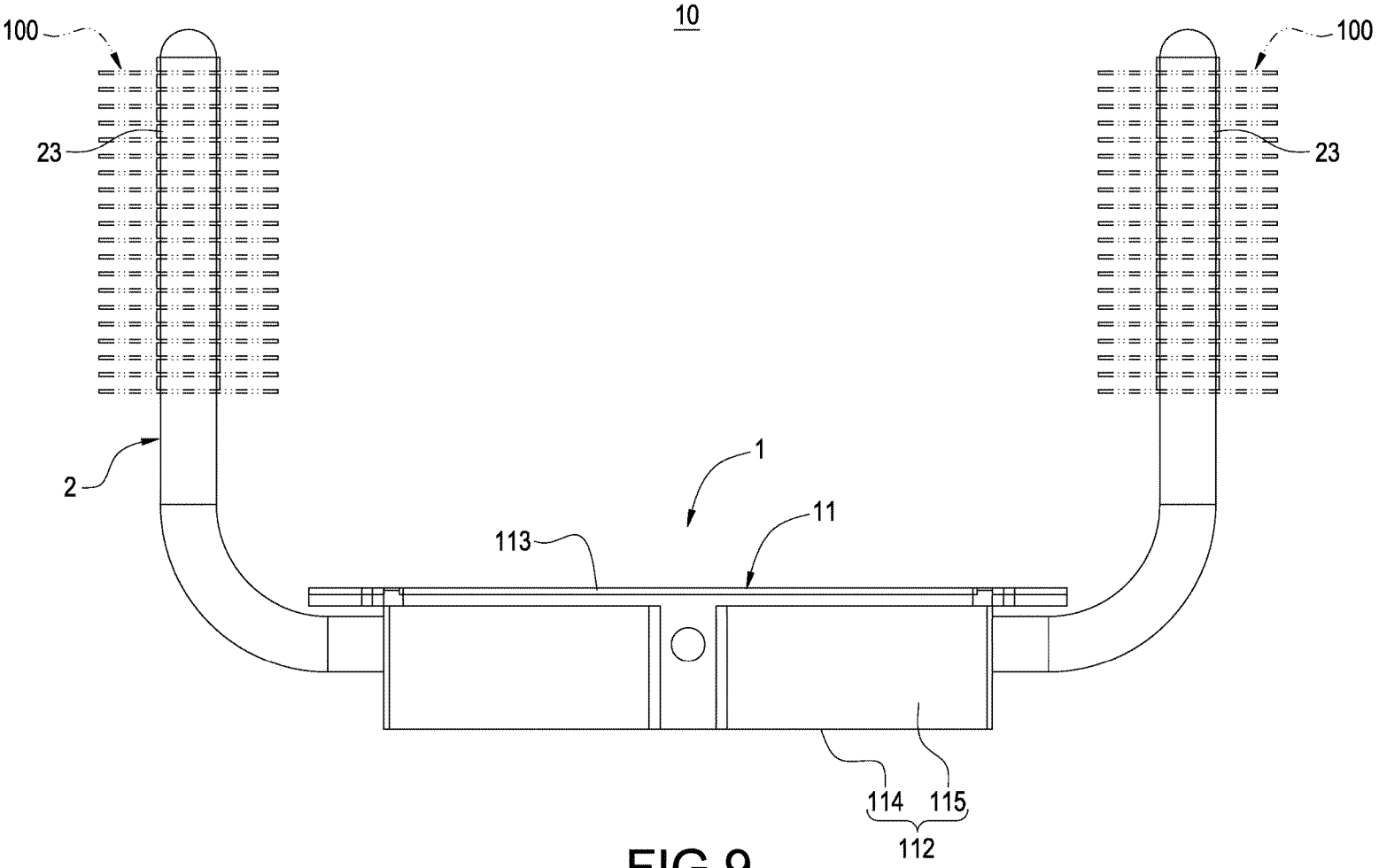
FIG. 9 is a schematic view showing the condense segment being arranged to be perpendicular to the heat spreader according to the present invention.

Please refer to FIG. 9, which is a schematic view showing the condense segment (23) being arranged to be perpendicular to the heat spreader (1); and as shown in FIG. 5, the condense segment (23) is arranged to be in parallel with the spreader (1). As such, according to the present invention, the condense segment (23) and the heat spreader (1) can be arranged to be in a parallel, perpendicular or staggered status, and the arrangement of the condense segment (23) and the heat spreader (1) are mainly based on the internal space of an electronic device, the installed locations of electric components and the preset heat transferring direction and shall not be served as a limitation to the scope of the present invention.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A heat dissipater having capillary component, including:

a heat spreader, including a shell member and a first capillary structure disposed in the shell member, wherein the shell member includes at least one through hole;

at least one heat pipe, received in the through hole and including a pipe member and a second capillary structure disposed in the pipe member, wherein the pipe member includes an opening formed in the shell member; and at least one capillary component, accommodated in the shell member and including a block member, wherein the block member is formed with a hollow zone which is connected with the shell member and the piper member, the hollow zone has a penetrated hole formed in the block member, and is extended with a protruding part, the block member is arranged adjacent to the first capillary structure, and the protruding part is received in the opening and arranged adjacent to the second capillary structure, wherein two opposite ends of the penetrated hole are respectively connected with the opening of the pipe member and an internal space of the shell member, and wherein the protruding part includes a convex piece extended from the block member, the convex piece protrudes from the outer periphery of the penetrated hole, and the convex piece is received in the opening and arranged adjacent to the second capillary structure.

2. The heat dissipater having capillary component according to claim 1, wherein the first capillary structure and the second capillary structure are respectively composed of a sintered member, a metal net member, one or a plurality of grooves or a combination thereof.

3. The heat dissipater having capillary component according to claim 1, wherein the capillary component is composed of a sintered member, a metal net member, one or a plurality of grooves or a combination thereof.

4. The heat dissipater having capillary component according to claim 1, wherein the heat pipe is formed with a condense segment, and the condense segment is arranged to be in parallel with the heat spreader.

5. The heat dissipater having capillary component according to claim 1, wherein the heat pipe is formed with a condense segment, and the condense segment is arranged to be perpendicular to the heat spreader.

6. The heat dissipater having capillary component according to claim 1, wherein the shell member includes a base and a cover plate covered on the base, the base is formed with a bottom wall and an annular wall annularly arranged on the bottom wall, the bottom wall is formed with a plurality of support pieces extended towards the cover plate, the through hole is formed on the annular wall, and the first capillary structure is disposed on the bottom wall.

* * * * *